US006742783B1

(12) United States Patent
Lawer et al.

(10) Patent No.: US 6,742,783 B1
(45) Date of Patent: Jun. 1, 2004

(54) SEAL SEGMENT FOR A TURBINE

(75) Inventors: Steven D Lawer, Derby (GB); Mark A Halliwell, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/987,461

(22) Filed: Nov. 14, 2001

(30) Foreign Application Priority Data

Dec. 1, 2000 (GB) ..... 0029337

(51) Int. Cl.[7] ..... F01D 11/02

(52) U.S. Cl. ..... 277/416; 277/412; 277/644; 415/174.4; 415/173.5

(58) Field of Search ..... 277/628, 630, 277/632, 637, 641, 644, 650, 651, 652, 653, 654; 415/173.4, 173.5, 180

(56) References Cited

U.S. PATENT DOCUMENTS

| | | | | | |
|---|---|---|---|---|---|
| 4,013,376 | A | | 3/1977 | Bisson | |
| 4,335,886 | A | * | 6/1982 | Frey et al. | 277/412 |
| 4,497,610 | A | | 2/1985 | Richardson | |
| 4,513,975 | A | * | 4/1985 | Hauser et al. | 277/415 |
| 4,679,981 | A | * | 7/1987 | Guibert et al. | 415/116 |
| 4,730,832 | A | * | 3/1988 | Cederwall et al. | 277/321 |
| 5,201,846 | A | * | 4/1993 | Sweeney | 415/173.6 |
| 5,374,161 | A | * | 12/1994 | Kelch et al. | 415/139 |
| 5,738,490 | A | * | 4/1998 | Pizzi | 415/139 |
| 6,089,821 | A | * | 7/2000 | Maguire et al. | 415/115 |
| 6,129,513 | A | * | 10/2000 | Halliwell et al. | 415/173.4 |
| 2001/0031201 | A1 | * | 10/2001 | Lawer et al. | 415/173.4 |

FOREIGN PATENT DOCUMENTS

| | | | | |
|---|---|---|---|---|
| GB | 2016606 | A | 9/1979 | |
| GB | 2168110 | A | 6/1986 | |
| GB | 2242710 | A | 10/1991 | |
| GB | 2245316 | A | 1/1992 | |
| WO | WO 9412775 | A1 * | 6/1994 | F01D/11/08 |

* cited by examiner

*Primary Examiner*—Anthony Knight
*Assistant Examiner*—Christopher J. Boswell
(74) *Attorney, Agent, or Firm*—W. Warren Taltavull; Manelli, Denison & Selter PLLC

(57) ABSTRACT

A seal segment (66) as described for a seal segment ring (64) of a turbine (16) in a gas turbine engine (10). The seal segment (66) has an inner surface (70) adapted to face the turbine blades (36) in use. Path means (72) is defined in the seal segment (66). The path means (72) is adapted to extend, in use, generally parallel to the principal axis of the turbine and has downstream inlet means (74) through which a cooling fluid to cool the seal segment can enter the path means (72) and upstream outlet means (76) from which the cooling fluid can be exhausted from the path means (72). The cooling fluid can flow along the path means (72) in a generally upstream direction opposite to the flow of gas through the turbine.

20 Claims, 5 Drawing Sheets

SEAL SEGMENT FOR A TURBINE

FIELD OF THE INVENTION

This invention relates to seal segments for gas turbine engines. More particularly, but not exclusively, the invention relates to seal segments for high pressure turbines of gas turbine engines. The invention also relates to wall structures for turbines formed of a plurality of seal segments.

BACKGROUND OF THE INVENTION

In gas turbine engines seal segments form a seal segment ring around the turbine blades of the engine. These seal segments can overheat because of leakage of hot gases flowing through the turbine around the tips of the turbine blades. This is a particular problem in high pressure turbines.

SUMMARY OF THE INVENTION

According to one aspect of this invention there is provided a seal segment for a seal segment ring of a gas turbine engine, the seal segment comprising a main body having an inner surface adapted to face the turbine blades in use, wherein path means for a cooling fluid is defined in the main body, the path means extending, in use, between upstream and downstream regions of the seal segment.

The main body may be formed as a one piece element.

According to another aspect of this invention there is provided a seal segment for a seal segment ring of a gas turbine engine, the seal segment having an inner surface adapted to face the turbine blades in use, wherein path means is defined in the seal segment, the path means being adapted to extend, in use, between upstream and downstream regions of the seal segment, and having downstream inlet means through which a cooling fluid to cool the segment can enter the path means and upstream outlet means from which the cooling fluid can be exhausted from the path means, whereby cooling fluid can flow along the path means in a generally upstream direction opposite to the flow of gas through the turbine.

The outlet means is preferably arranged, in use, upstream of the turbine blades. In one embodiment, the outlet means for the cooling fluid is arranged to open in a downstream direction. In another embodiment, the outlet means is directed generally radially inwardly. Thus, in these embodiments, cooling fluid exhausted from the path means may pass over said inner surface of the segment in a downstream direction. The outlet means may be directed, in use, at an angle to the principal axis of the turbine, such that cooling fluid exits from the path means in substantially the identical direction to the flow of gas through the turbine at said outlet means.

The path means preferably extends, in use, generally parallel to the principal axis of the turbine. A preferred embodiment of this invention has the advantage that improved heat transfer is achieved by the provision of path means in which the flow of cooling fluid is from a downstream region of the seal segment to an upstream region. The flow of the cooling fluid in the path means in this preferred embodiment is counter to the main flow of gas through the engine, having the advantage of increasing heat transfer. The inlet means may be angled, in use, relative to the principal axis of the turbine such that the flow of the cooling fluid through the path means is substantially directly opposite to the flow of gas through the engine.

The path means preferably extends to one or more regions of the main body adjacent the inner surface to provide cooling at the, or each, of said regions in use.

Preferably, the path means comprises at least one passage which is preferably elongate, and the passage may extend laterally across the seal segment, preferably in a generally circumferential direction, in use. Preferably each seal segment defines two or more of said passages, which may be defined side-by-side, and each may extend laterally across the segment part way, preferably substantially half way. The path means may comprise a plurality of such passages each passage preferably extending generally parallel to the principal axis of the turbine in use. Preferably, the path means is configured to conform substantially to the profile of said inner surface.

The seal segment may include a plurality of heat removal members in the path means. The heat removal members may be in the form of pedestals, which may extend from a radially inner wall of the path means to a radially outer wall of the path means.

The path means may comprise one or more steps. In one embodiment, the path means comprises first and second axial sections, the first section extending from the inlet means to a region upstream thereof, and the second section extending from said region to the outlet means. The first and second sections may axially overlap and a conduit may extend between the first and second sections in said region. The configuration of said conduit is preferably arranged to produce impingement cooling of said seal segment by the cooling fluid as it enters the second section from said conduit. Alternatively, or in addition, the configuration of the conduit may be arranged to produce cooling of the seal segment by other enhanced heat transfer mechanisms. In another embodiment the path means comprises a single axial section which may include one or more steps.

In one embodiment, the path means extends to one or more regions of the seal segment adjacent the inner surface of the seal segment.

According to another aspect of this invention, there is provided a seal segment ring for a turbine of a gas turbine engine, the seal segment ring being formed from a plurality of seal segments as described above, the segments being arranged, in use, circumferentially around the turbine.

Preferably, the path means of successive segments defines a plurality of axially extending passages arranged side-by-side circumferentially around the seal ring to define an annulus of said cooling passages.

According to another aspect of this invention there is provided a core for use in a method of making a seal segment, the core comprising a main portion to form path means in the seal segment and projection means extending therefrom. In the preferred embodiment, the projection means is so arranged on the main portion and so configured to minimise the amount of material used in the method.

Preferably, the projection means is arranged generally centrally of the core conveniently on a substantially central axis. The projection means may comprise a first projection extending from a first surface of the main portion, and a second projection extending from a second surface of the main portion. The first surface is preferably a longitudinally and laterally extending surface. The second surface is preferably an edge surface, conveniently a laterally extending edge surface.

The first projection may have a generally cylindrical region, and the second projection may have a generally conical main region. The first projection may include a connecting region to connect the main region to the surface, the connecting region tapering outwardly from the main region.

BRIEF DESCRIPTION OF THE DRAWINGS

An embodiment of the invention will now be described by way of example only with reference to the accompanying drawings, in which.

DETAILED DESCRIPTION OF THE INVENTION

Figure 1:
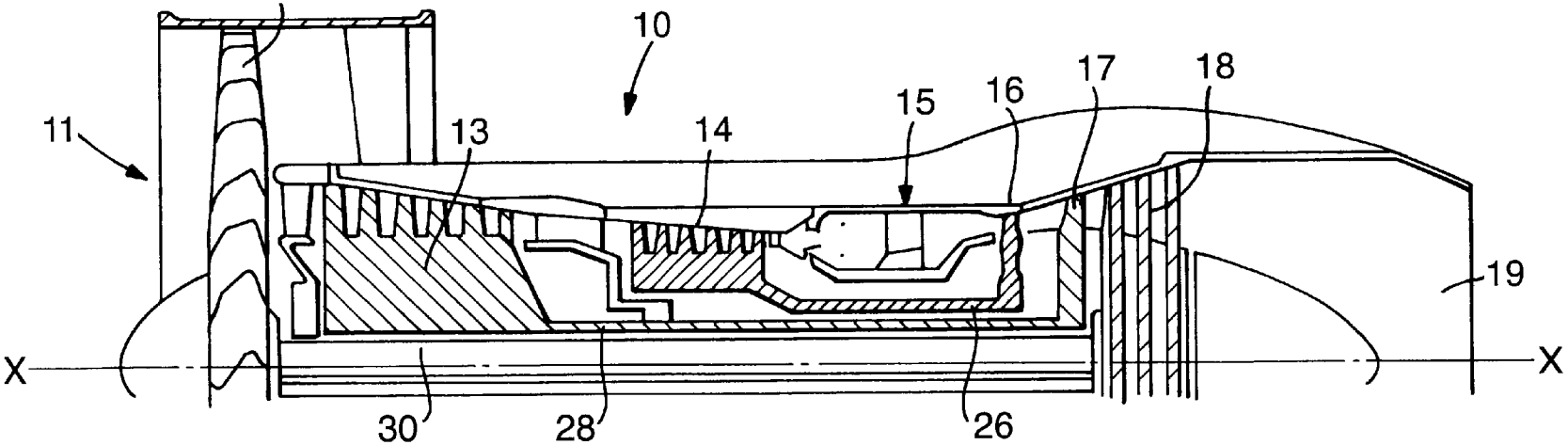
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
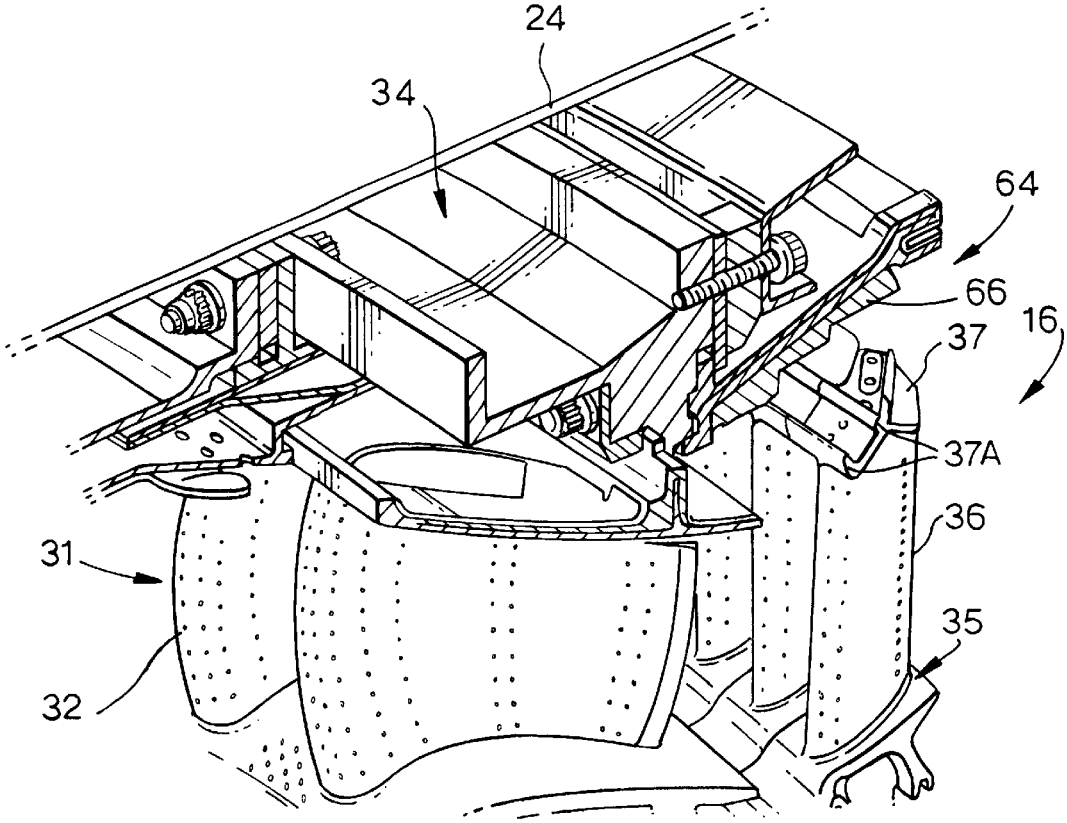
FIG. 2 is a perspective view of part of a high pressure turbine of an example of the engine shown in FIG. 1.

Referring to FIG. 2, there is shown part of a high pressure turbine 16 which is a single stage turbine and is connected to, and drives, the high pressure compressor 14 via a shaft 26. It will be appreciated that the turbine could be a multiple stage turbine, for example a two stage turbine. A casing 24 extends around the high pressure turbine 16 and also extends around the intermediate and low pressure turbines 17 and 18.

The high pressure turbine 16 comprises a stator assembly 31 in the form of an annular array of fixed guide vanes 32 arranged upstream of a rotor assembly 35 comprising an annular array of turbine blades 36 rotatably mounted on the shaft 26 (see FIG. 1). A support structure 34 for the guide vanes 32 extends circumferentially around the array of guide vanes 32 which are fixedly mounted on the support structure 34.

A wall structure or seal segment ring 64 is shown schematically in FIG. 2 and extends circumferentially around the array of turbine blades 36. The seal segment ring 64 comprises a plurality of seal segments 66 together defining the annular seal segment ring 64. In the embodiment shown, the blades 36 are provided with shrouds 37, but it will be appreciated that the blades 36 can be shroudless. The shrouds 37 comprise ribs or other projections 37A.

The intermediate and low pressure turbines 17 and 18 also comprise arrangements of guide vanes and rotor blades. The intermediate pressure turbine 17 receives air from the high pressure turbine 16 and is connected to and drives the intermediate pressure compressor 13 via a shaft 28 (see FIG. 1). Similarly, the low pressure turbine 18 receives air from the intermediate pressure turbine 17 and is connected to, and drives, the fan 12 via a shaft 30 (see FIG. 1).

Figure 3:
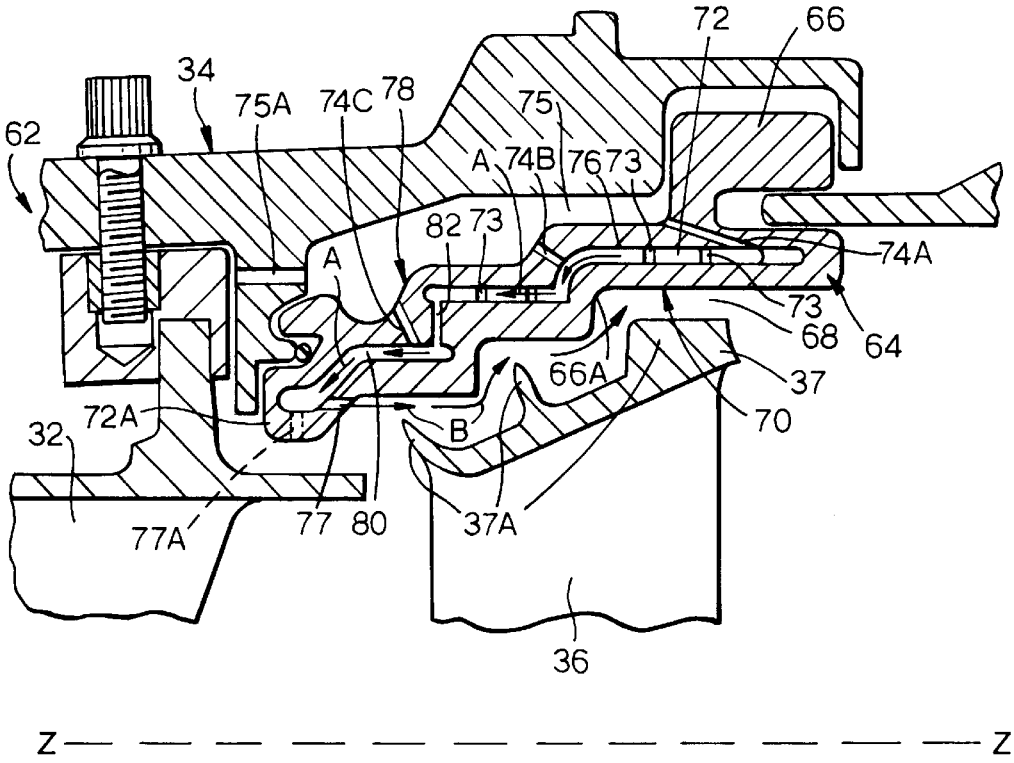
FIG. 3 is a vertical cross-section through part of the turbine arrangement shown in FIG. 2 showing one embodiment.

Referring to FIG. 3, there is shown diagrammatically a sectional view of part of the high pressure turbine 16 shown in FIG. 2. FIG. 3 shows in detail the support structure 34 for the nozzle guide vanes 32. The support structure 34 supports the guide vanes in a known manner through first mounting means 62 at the downstream end region of the array of guide vanes 32 and further mounting means (not shown) at the upstream end region.

In the embodiment shown, the support structure 34 also supports a seal segment ring 64 extending circumferentially around the array of high pressure turbine blades 36. The seal segment ring 64 comprises a plurality of seal segments 66, only one of which is shown in FIG. 3.

The seal segment ring 64 is disposed in substantial radial alignment with the turbine blades 36 and a gap 68 is defined between the shrouds 37 of the blades 36 and the seal segment ring 64. Each seal segment 66 has an inner surface 70 facing the blades 36. The inner surface 70 has a profile which corresponds generally to the shape of the shrouds 37 of the turbine blades 36.

The seal segment 66 shown in the drawings includes a main body 71 which defines therein path means in the form of a plurality of passages 72 in the seal segment 66 to allow the flow therethrough of cooling fluid in the form of cooling air. The main body 71 may define one or more passages 72, each of which, in the embodiment shown, extends generally parallel to the principal axis Y—Y of the turbine arrangement, the line Z—Z in FIG. 3 being parallel to the axis Y—Y. Each passage 72 also extends laterally of the seal segment 66 substantially half way across.

In the embodiment shown, the main body 71 of each seal segment 66 defines two passages 72 arranged side-by-side and separated from each other by a wall. It will be appreciated that in other embodiments the main body 71 may define more than two of the passages 72, e.g. four passages 72. The plurality of passages 72 are defined by the main bodies 71 of the respective seal segments 66 arranged side-by-side circumferentially around the seal segment ring 64, and together form an annular array of passages around the turbine blades 36. Each passage 72 is provided with heat removal members in the form of pedestals 73 extending between the radial inner and outer walls of the passages 72. The heat removal members could take other forms, for example ribs or other features to cause turbulent flow.

A downstream inlet 74A extends through the seal segment 66 from a radially outer surface to the passage 72 at the downstream end region of the seal segment 66, to allow air to enter the passage 72 from an annular space 75. Air is supplied to the space 75 via a conduit 75A in the support structure 34. On entering each passage 72, air flows from the inlet 74A to an outlet 77 in the upstream direction, as indicated by the arrows A. The flow of air along the passage 72 extracts heat from the surrounding material thereby cooling the material.

Further inlets 74B and 74C may be provided upstream of the inlet 74A and may allow air to enter the passage 72 at various locations upstream from the inlet 74A. The number and position of the inlets can be varied as desired to provide localised cooling of pre-selected areas of the seal segment 66. For example, the inlet 74B may be provided to cool a region 66A of the seal segment 66, which may have been found on testing to be prone to overheating. Similarly, other regions which are prone to overheating may be provided with inlets opposite to direct incoming cooling air directly onto such regions.

Since the air flowing through the turbine 17 may be swirled, i.e. it flows at an angle to the principal axis of the turbine, the outlets can be angled such that air exhausted from the passages 72 is directed in the substantially identical direction to the main flow of air through the turbine 17.

As can be seen in FIG. 3, each passage 72 of each of the seal segments 66 is configured to conform generally to the profile of the inner surface 70 of the seal segment ring 64. Each passage 72 comprises a first section 76 extending from the downstream inlet 74A to a central region 78 of the seal segment 66. A second section 80 extends from the region 78 to the outlet 77. The first and second sections overlap and a connecting conduit 82, of narrower diameter than the sections 76, 80 extends from the first section 76 to the second section 80 in the central region 78. Thus, as the cooling air enters the second section 80 from the connecting conduit 82, it impinges upon the walls of the second section 80 of the passage 72 to effect impingement cooling of the walls. Along the rest of the passage 72 cooling is effected by transpiration cooling or other types of cooling, for example convection and conduction.

The outlet 77 may open in the downstream direction and directs air, as shown by the arrows B along the inner surface 70 of the seal segment ring 64. This has a two-fold effect. First, it provides cooling of the surface 70 and/or the blade 36. Second, it ensures that it is the air flow from the passages 72 which passes through the gap 68 in preference to the air which is swirled from the guide vanes 32, which is better used in driving the blades 36 thereby improving work output and efficiency. Alternatively, the outlet 77A may be arranged to extend radially inwardly, as shown by the dashed lines. With this alternative arrangement, the air exiting from the passages 72 via the outlet 77A may be directed in the same direction as air exiting from outlets 77 by the pressure thereon.

Figure 4:
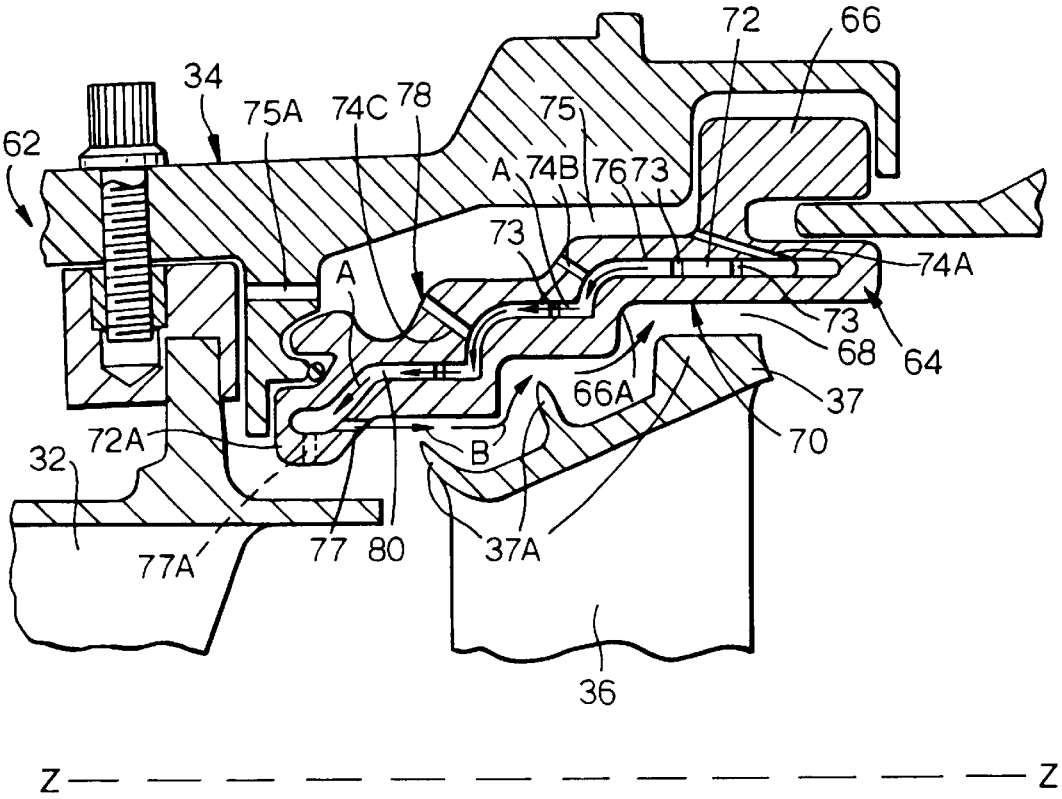
FIG. 4 is a view similar to FIG. 3 showing another embodiment of a seal segment.

In another embodiment, as shown in FIG. 4, the passage 72 is a single passage extending in a stepwise configuration from the upstream end region to the downstream end region. In FIG. 4, all the features have been allocated the same reference numeral as in FIG. 3. FIG. 4 differs from FIG. 3 in that the conduit 82 is omitted.

As with the embodiment shown in FIG. 3 and described above, the number and position of the inlets can be varied as described to cool regions of the seal segment 66 which are prone to overheating.

An advantage of the above described embodiments is that it allows cooling passages 72 to be formed as close as possible to the radially inner surface 70 of each seal segment 66. For example, in each of the embodiments the channel 72 defines a region 72A adjacent the outlet 77. The material of the seal segment surrounding the region 72A is prone to overheating and the regions 72A provides cooling fluid to prevent such overheating.

The seal segments 66 are manufactured by an investment casting process, which typically involves forming a master die from an original pattern and casting from that master die a working pattern in wax (or a similar material). After the wax working pattern has been formed, it is coated in a ceramic shell to form a final mould. The final mould is then fired in an oven until it is set. The heat of firing melts the wax, enabling it to run out. After firing, molten metal alloy is poured into the mould to form the segment. When the metal has solidified, the mould is destroyed to remove the seal segment.

The formation of the seal segments 66 of the preferred embodiment are cast using generally the above method, but after the master die has been formed, cores 110 (see FIGS. 5 and 6) are arranged in the die. The cores are formed of a ceramic material and will eventually form the passages 72. The molten wax is injected in the die and forms around the cores 110. After firing the final mould, and melting out the wax working pattern, the cores remain in place. When the molten metal has been poured into the final mould and allowed to solidify, the cores 110 are dissolved away by pouring in a suitable solution, for example an acidic solution to form the passages 72.

Figure 5:
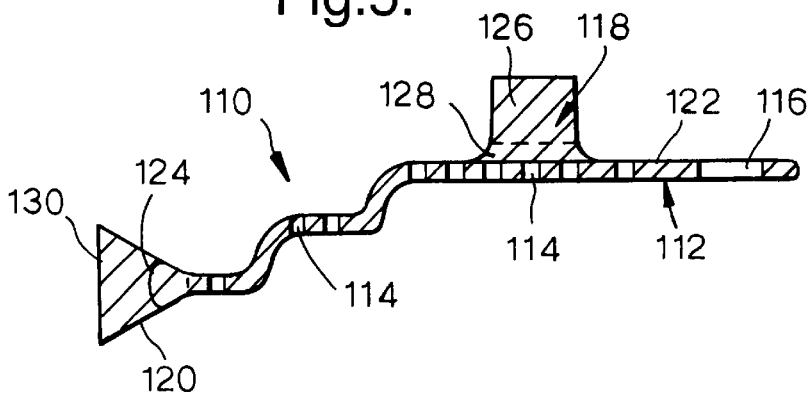
FIG. 5 is a side view of a core for use in forming path means in a seal segment.
Figure 6:
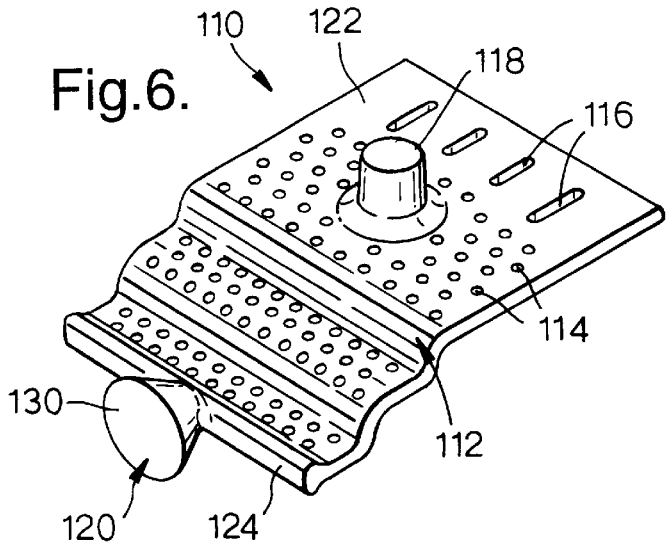
FIG. 6 is a perspective view of the core shown in FIG. 5.

An example of a core 110 is shown in FIGS. 5 and 6. The core 110 comprises a main portion 112 which, as can be seen, has a configuration which corresponds to the passages 72 shown in FIGS. 3 and 4. The core 110 also extends laterally and has a width which is substantially equal to half the circumferential length of the seal segment 66 which is to be formed around it. The main portion 112 defines a plurality of cylindrical through bores 114 which will form the pedestals 73, and a plurality of through slots of elongate configuration which will form stiffening ribs 82 in the seal segment 66 formed using the core 110.

First and second projections 118, 120 extend outwardly from the main portion 112. These are provided to assist in the casting of the passages 72 in the seal segments 66. If reference is made to FIG. 5, the first projection 118 extends from surface 122 of the core 110 and the second projection 120 extends from an edge 124 of the core 110. For ease of reference, in FIG. 5, the surface 122 is referred to as upper surface and the edge 124 is referred to as the left hand edge of the core 110. However, it will be appreciated that the surfaces and the edge do not need to be upper or left hand.

The first projection 118 comprises a main region 126 of a generally cylindrical configuration, and a connecting region 128 which tapers outwardly from the main region 126 to connect the main region 126 to the surface 122. The second projection 120 comprises a substantially conical main region 130 which tapers outwardly from the edge 124.

Figure 7:
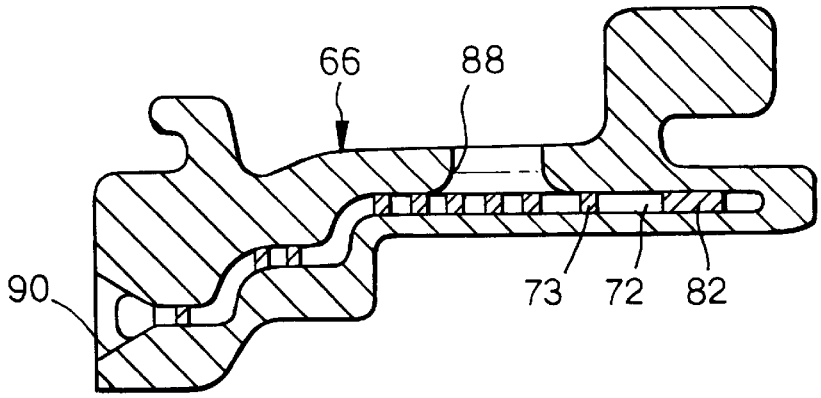
FIG. 7 is a side view of a seal segment during a process of forming the seal segment.

Referring to FIG. 7, there is shown a seal segment 66 just after the ceramic core 110 has been dissolved away. Extending from the channel 72 is a first aperture 88 in a radially outward direction, and a second aperture 90 in an upstream direction. The first and second apertures 88, 90 are formed respectively from the first and second projections 118, 122 after the core 110 has been dissolved away. In order to complete the manufacture of the seal segment 66 the apertures 88, 90 are plugged with an appropriate material, for example a welding material. Inlets and outlets can be drilled in desired positions before or after the apertures 88, 90 have been plugged. The drilling can be carried out by any suitable technique, for example by the use of lasers or by EDM (Electro Discharge Machining).

The position, size and shape of the first and second projections 118, 120 is carefully selected in the embodiment described to allow the core 110 to be held securely by the master die when the wax working pattern is formed and also by the final mould during the pouring of the metal alloy and its subsequent cooling and solidifying. Further, the first and second projections also minimise the amount of material required to form the core 110 and to form the plugs in the first and second apertures 88, 90.

Various modifications can be made without departing from the scope of the invention. For example, the passages 72 could be formed of several sections, with connecting conduits extending between adjacent sections. Moreover while the invention has particular application in relation to high pressure turbines, similar arrangements may be used in association with low or intermediate pressure turbines if desired. Further, the passages 72 need not extend precisely parallel to the principal axis of the turbine. The passages 72 could instead be arranged to allow circumferential swirl of the cooling air passing therethrough.

There is thus described a seal segment, the preferred embodiment of which allows inlets and/or outlets to be drilled in desired numbers and in desired positions to provide the most appropriate cooling in the segment. This provides the advantage that the cooling can be tuned to a fine degree without any changes in casting or in the core, as may be the case for the different requirements for different engines or in response to engines or components tested or run under different conditions, for example different altitude or different temperature.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A seal segment for a seal segment ring of a gas turbine engine, the seal segment comprising a main body having an inner surface adapted to face blades in use, wherein path means for a cooling fluid is defined in the main body, the path means extending, in use, between upstream and downstream regions of the seal segment.

2. A seal segment according to claim 1 wherein the main body is formed as a one piece element.

3. A seal segment according to claim 1 wherein the path means has upstream inlet means through which a cooling fluid to cool the segment can enter the path means, and downstream outlet means from which the cooling fluid can be exhausted from the path means.

4. A seal segment for a seal segment ring of a gas turbine engine, said seal segment having upstream and downstream regions, the seal segment comprising a main body having an inner surface adapted to face blades in use, wherein path means for a cooling fluid is defined in the main body, the path means extending, in use, between said upstream and downstream regions of the seal segment wherein the path means has downstream inlet means through which a cooling fluid to cool the segment can enter the path means, and upstream outlet means from which the cooling fluid can be exhausted from the path means, whereby cooling fluid can flow along the path means in a generally upstream direction opposite to the flow of gas through the engine.

5. A seal segment according to claim 4, wherein the outlet means for the cooling fluid is arranged to open in a downstream direction, whereby cooling fluid exhausted from the path means may pass over said inner surface of the segment in a downstream direction.

6. A seal segment according to claim 5 wherein the outlet means is directed at an angle to the principal axis of the turbine such that cooling fluid can exit from the path means in substantially the same direction as the flow of gas through the turbine at said outlet means.

7. A seal segment according to claim 4 wherein the outlet means for the cooling fluid is directed generally radially inwardly.

8. A seal segment according to claim 1, wherein the path means extends to one or more regions of the main body adjacent the inner surface to provide cooling at the, or each, said region in use.

9. A seal segment according to claim 1, wherein the path means comprises at least one elongate passage which extends laterally across the seal segment.

10. A seal segment according to claim 9 wherein the path means comprises at least two of said passages defined side-by-side in the segment, each extending laterally across the segment substantially half-way.

11. A seal segment according to claim 1, wherein the path means is configured to conform substantially to the profile of said inner surface.

12. A seal segment according to claim 11, wherein the path means comprises first and second axial sections, the first axial section extending from the inlet means to a region upstream thereof, and the second axial section extending from said region to the outlet means.

13. A seal segment according to claim 12, wherein the first and second axial sections overlap each other and a conduit extends between the first and second axial sections in said region, said second axial section including a wall structure, the configuration of said conduit being arranged to produce impingement cooling of said wall structure by the cooling fluid as it enters the second axial section from said conduit.

14. A seal segment according to claim 11 wherein the path means comprises a single axial section.

15. A seal segment according to claim 1 wherein the path means includes a plurality of heat removal members.

16. A seal segment according to claim 15 wherein the heat removal members extend from a radially inner wall of the path means to a radially outer wall of the path means.

17. A seal segment ring for a turbine of a gas turbine engine, the seal segment ring being formed from a plurality of seal segments as claimed in claim 1.

18. A seal segment ring according to claim 17, wherein the path means of successive segments defines a plurality of axially extending cooling passages arranged side-by-side circumferentially around the seal ring to define an annulus of said cooling passages.

19. A turbine for a gas turbine engine incorporating a seal segment ring as claimed in claim 17.

20. A gas turbine engine incorporating a turbine as claimed in claim 19.

* * * * *